US006079118A

United States Patent [19]

Kiyokawa

[11] Patent Number: 6,079,118

[45] Date of Patent: Jun. 27, 2000

[54] CONTINUOUS DRYING SYSTEM

[76] Inventor: Shin Kiyokawa, 402, Benten-cho, Soka-shi, Saitamo 340004, Japan

[21] Appl. No.: 09/235,955

[22] Filed: Jan. 22, 1999

[30] Foreign Application Priority Data

Jan. 23, 1998 [JP] Japan ..... 10-010967

[51] Int. Cl.[7] ..... F26B 11/02

[52] U.S. Cl. ..... 34/134; 34/135; 34/138; 34/139; 34/147; 34/182; 34/185

[58] Field of Search ..... 34/134, 135, 138, 34/139, 147, 182, 185, 378, 379, 386, 393, 403, 417, 471, 482, 486; 366/4, 11, 25; 210/296, 297, 298

[56] References Cited

U.S. PATENT DOCUMENTS

| | | | |
|---|---|---|---|
| 2,899,176 | 8/1959 | Francis et al. | 34/134 |
| 3,486,740 | 12/1969 | Christian | 34/134 |
| 3,630,720 | 12/1971 | Messner | 210/366 X |
| 4,030,205 | 6/1977 | Robertson et al. | 34/380 |
| 4,104,958 | 8/1978 | Manser et al. | 99/355 |
| 4,476,019 | 10/1984 | Nowisch et al. | 34/147 X |
| 5,047,123 | 9/1991 | Arvanitakis | 34/73 X |
| 5,531,034 | 7/1996 | Mentz | 34/182 X |
| 5,628,126 | 5/1997 | North | 34/135 |
| 5,664,881 | 9/1997 | Hawkins et al. | 366/4 |
| 5,946,815 | 9/1999 | Wetzel | 34/182 X |

*Primary Examiner*—Stephen Gravini
*Attorney, Agent, or Firm*—Webb Ziesenheim Logsdon Orkin & Hanson, P.C.

[57] ABSTRACT

A continuous drying system for flake-formed or granular solid, of which bottom inside surface is semi-cylindrical and arranged almost horizontally, comprises drying system main body having a supplying means of a drying object at one end thereof and having a discharging means at the other end thereof, and a coil-formed sending apparatus arranged rotatably inside the main body, and a bar-formed or blade-formed stirring member arranged between the sending apparatus transversely. The drying object is transferred by said coil-formed sending apparatus, and a part of the drying object is retreated while stirring by scooping up the drying object with the stirring member along the inside surface of the main body of the drying object. The transfer of the drying object is delayed in comparison with the rotation of the sending apparatus.

7 Claims, 7 Drawing Sheets

Fig. 6
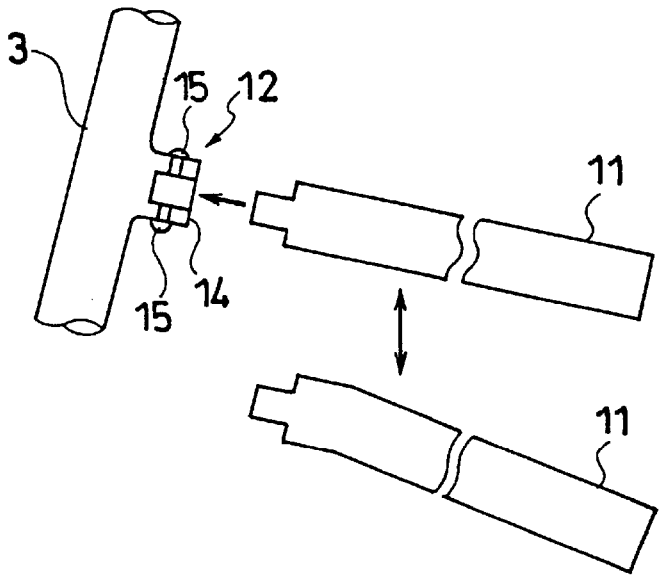
Fig. 7 (a)
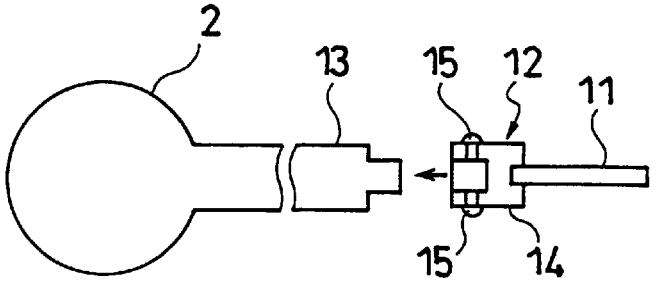
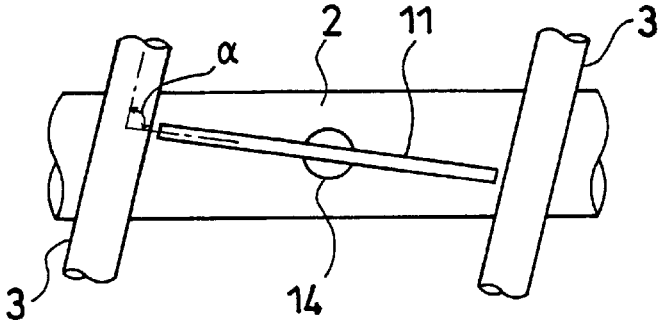
Fig. 7 (b)

CONTINUOUS DRYING SYSTEM

BACKGROUND OF THE INVENTION

The present invention relates to a continuous drying system for drying a flake-formed or granular solid, or a small piece of solid, and particularly relates to a continuous drying system to dry effectively sliced vegetables such as a cabbage, a carrot, a leek, an onion, burdock, and garlic or sliced fruits such as an apple, a persimmon, a banana, etc. or small pieces of tea leaves and medicinal herbs or granular foods such as rice, wheat and barley, beans, etc., without deterioration of their quality.

Conventionally, various continuous drying systems have been proposed by using a horizontal drum mixer, as drying means for drying effectively by transfer of powder and granular bodies stirring. For example, FIG. 11(*a*) and FIG. 11(*b*) are sectional block diagrams illustrating a screw mixer and a paddle mixer, respectively, as representative conventional examples of drum mixers.

The screw mixer has a spiral ribbon screw 32 engaged with the axis of rotation 31 supported on the shaft center of a horizontal cylindrical container 30 and a solid body is transferred in to one direction stirring by the ribbon screw. On the other hand, the paddle mixer has many plate stirring wings 33—replaced to the ribbon screw—tilted in a certain direction against the axis of rotation 31 engaged with the end of an arm.

In any systems aforementioned, drying is carried out by stirring during transferring a drying object from one end to the other end of a container 30 with a screw 32 or a paddle 33 on the basis of passing heated air through the cylindrical container 30 (a drum) or heating the cylindrical container 30 from outside.

However, in the continuous drying system by using the screw mixer and the paddle mixer, the increment of the rotation speed of the axis of rotation for reinforcing stirring increases a transfer speed of the drying object proportionally. Therefore, it is difficult to control freely the time for retention and drying of the drying object in the cylindrical container contacting enough with a heated gas by vigorous stirring.

There are some problems: differences in the shape, size, water content, and drying rate of the drying object; necessities of regulating the drying object to supply to the drying system to an optimal quantity. In conventional drying systems, rotation of the screw 32 or the paddle 33 strongly relates to transfer speed to make independent regulation difficult. Thus, it is required to design the drying system according to the properties of the drying object. Subsequently, drying process by using a single system is difficult for different drying objects.

On the other hand, in order to yield a dried food giving a good flavor and taste, drying is necessary at an appropriate temperature to prevent a considerable change of the quality of a material. A common method for yielding a dried food giving a good flavor and taste is drying in the sun and a natural wind for preparation of a dried fish. However, this method is inappropriate for industrial mass production due to the effect of natural environment such as weather and seasons, a place for drying is restricted, and a low productivity caused by a large consumption of labor and time for drying function.

Industrial drying methods so far frequently employed include a method for drying by contacting gas discharged by burning of light oil directly with a drying object or a method by contacting the drying object with a high temperature air generated by a heat exchanger.

However, in consideration of the conditions of natural drying to yield a dried fish having satisfactory flavor and taste, mild drying at a normal temperature or a temperature near a room temperature is preferable as possible. However, this condition is difficult to realize industrially. There are problems, for example: when the temperature of a food under drying becomes relatively high such as 50° C. its activate performance of enzymes in a food to oxidize and easily decompose a useful component and flavor component finally resulting in deterioration of taste. In addition, a high drying temperature causes unevenly dried and excessively dried parts, denaturalization of the food, and deterioration of eating sensation (chewing sensation).

Drying rate decreases greatly at a low drying temperature near a room temperature such as 40° C. or under. Therefore, drying at these temperatures requires that the drying object be contacted with environmental air as possible, practically by vigorous stirring.

Drying vegetables, fruits, fishes, etc. requires to adjust water remained in a food after drying to appropriate content. Excessive drying causes deterioration of a flavor of the food and hardens the food, and, on the contrary, insufficient drying keeps the food soft, but does not allow long term preservation easily. Therefore, it is required to adjust remained water content in a given narrow range. For the purpose, it is important to regulate drying time accurately.

As described before, there is a problem where it is difficult to realize the following double operations in the conventional drum mixer: regulating freely the transfer speed of a solid body accompanied with stirring satisfactorily the same.

Thus, the present invention is intended to overcome the problems in the prior art by providing a drying means having large drying rate by improving contact of a drying object with an ambient gas through a stirring means capable of increasing the degree of dryness without increasing the transfer speed of the drying object in continuous drying of a flake-formed or granular solid.

In addition, the present invention provides a means for regulating retention time, i.e. drying time, of the drying object in a drying room to a given value by free regulation of the transfer speed of the drying object even under a very vigorous stirring condition.

Further, the present invention provides a means for yielding preservative equipment and flavorful dried foods or dried medicinal herbs by drying effectively and evenly flake-formed or granular foods at a low drying temperature in combination with the aforementioned stirring means with an appropriate heating means.

SUMMARY OF THE INVENTION

In order to solve said problems, the continuous drying method according to the present invention comprises;

A continuous drying method for drying continuously a flake-formed or granular drying object, comprising: a drying system main body disposed horizontally, of which bottom interior shape is semi-cylindrical, having a means for supplying the drying object to one end and a means for discharging the drying object from the other end, having lays and long axis, a means for heating the drying object in said drying system main body and/or a means for supplying a gas for drying in said drying system main body, and a coil-formed sending apparatus arranged in a rotation shaft, which is driven by rotation of a driving machine, arranged on the axis of a semi-cylindrical bottom of said drying system main body and of which rotation speed is variable and a returning system arranged between the sending apparatus, wherein the retention time of the drying object in the drying system main body is regulated transferring a part of said drying object in a reverse direction by the returning system while transferring the drying object by said sending apparatus from supply side to discharge side.

In addition, the continuous drying system according to the present invention is constituted as follows.

A continuous drying system for a flake-formed or granular solids comprising:

a drying system main body, having a means for supplying a drying object to one end thereof and a means for discharging the same to the other end thereof, which has a semi-cylindrical inside bottom and is approximately horizontally installed, a means for heating the drying object in the drying system main body or/and a means for providing the drying gas, to the drying system main body, a rotation shaft arranged on the axis of the semi-cylindrical bottom of the drying system main body and driven rotated by a driving machine with a variable rotation speed, a coil-formed sending apparatus, composed of a cylindrical coil of which outer diameter is somewhat smaller than the diameter of shaft of the semi-cylindrical bottom of the drying system main body, transferring the drying object by the rotation of said rotation shaft to which said sending apparatus is mounted through a supporting bar, and many bars or blade-formed stirring members arranged in a position of bridging between pitches of the coil along the outer circumference of the coil of said sending apparatus and mounted to said coil or said rotation shaft, wherein by a stirring member a retreat movement is given the drying object by a stirring member mounted to the coil or the rotation shaft to make a tilting angle of the stirring member to the coil larger than the tilting angle to the axis direction of the coil.

BRIEF DESCRIPTION OF THE DRAWINGS

FIG. 2(*b*) is a front view thereof;

FIG. 6 is an explanatory illustration showing a method for mounting a stirring member to the coil-formed sending apparatus shown in the FIG. 3;

FIGS. 7(*a*)–7(*b*) are explanatory illustrations showing another method for mounting a stirring member to the coil-formed sending apparatus shown in the FIG. 4;

FIG. 11(*a*) shows a ribbon mixer and FIG. 11(*b*) shows a paddle mixer.

DESCRIPTION OF THE PREFERRED EMBODIMENTS

Herewith, the embodiments according to the present invention will be described in detail with reference to the drawings.

Figure 1:
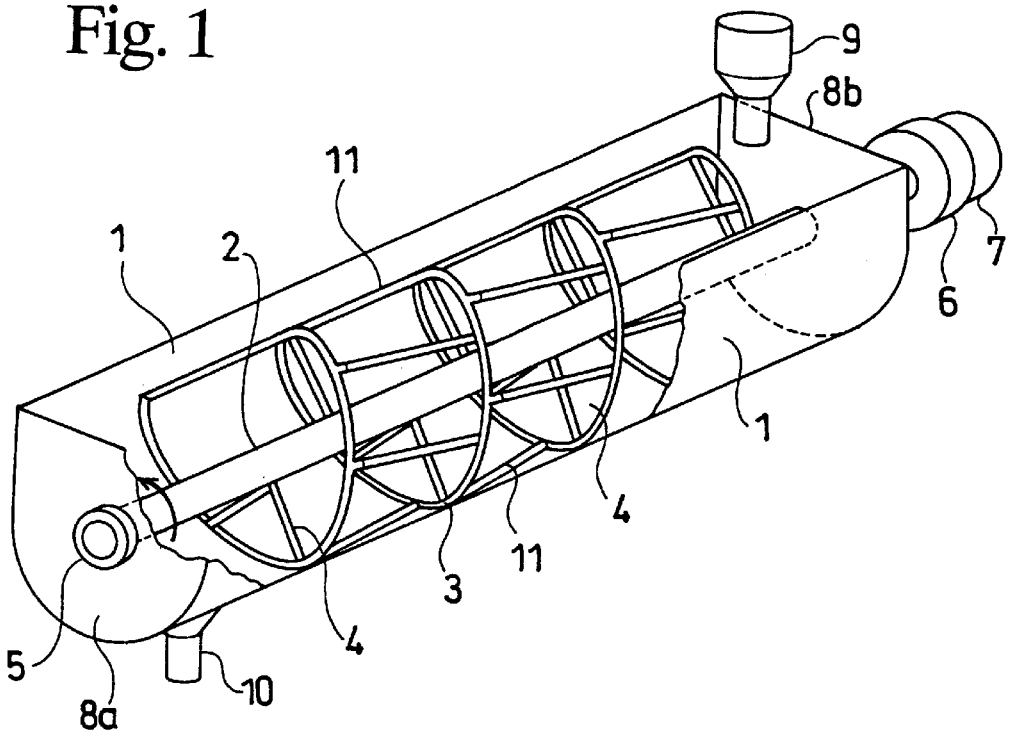
FIG. 1 is a partially fragmented showing perspective side view the inside structure of a continuous drying system, an embodiment of the present invention.
Figure 2:
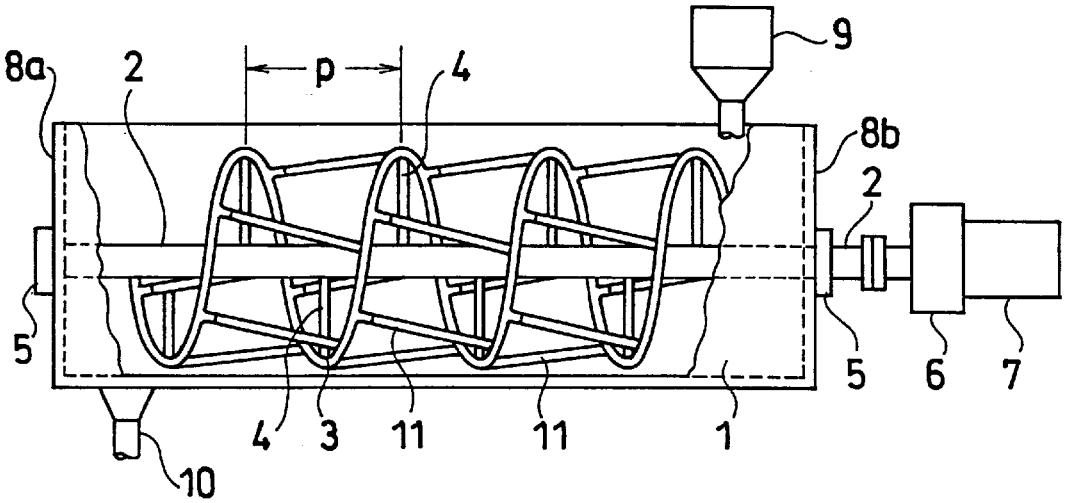
FIG. 2(*a*) is a partially fragmented, side view showing a part of the continuous drying system of the FIG. 1.
Figure 2:
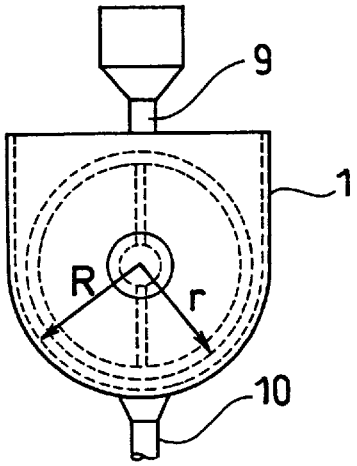

In the FIG. 1 and FIG. 2 (*a*) and FIG. 2 (*b*), a drying system main body 1 has an inside bottom of semi-cylindrical shape, a shape of laterally long container of which both surfaces of side wall are elongated parallel to the upper direction, and usually almost horizontal arrangement. A rotation shaft 2 is supported on the center of the main body 1 in parallel to the longitudinal direction. A (solenoid) coil-formed sending apparatus 3 is mounted to the rotation shaft 2 with a supporting bar 4.

The rotation shaft 2 above-mentioned is supported by bearings 5, 5 arranged on the end boards 8 and 8*b* of both ends of the main body 1 and driven by rotation of a motor 7 through a transmission 6 connected to one end. The center of the rotation shaft almost matches the central axis (the line passing through the center of the arc of bottom surface) of the semi-cylindrical main body 1.

The outer radius r of the coil of the sending apparatus 3 is somewhat smaller than the inner radius R of the arc of the bottom surface of main body 1. The supporting bar 4 is made to have a constant height. By the constitution, a certain clearance (R−r) is formed between the outer surface of the coil of the sending apparatus 3 and the surface of the inner wall of the main body 1 to send a drying object smoothly by the sending apparatus 3. In the examples shown in FIG. 1 and FIG. 2, bearings 5, 5 are mounted to the end boards 8*a* and 8*b* of the ends of the main body 1. However, the bearings 5, 5 are not considered as restricted to the mounting position shown in the present figures and may be mounted to another position.

A supplying hopper 9 for the drying object and a discharge outlet 10 are mounted to the top part of one end of the main body 1 and the bottom part of the other end, respectively. Besides, not shown in any figures, a far-infrared heater or an electric heater, and a means, such as vapor jacket, to heat the drying object or/ and a means to supply a gas (heated air) for drying are mounted to the main body 1. The drying object passing through inside of the main body 1, as a drying room, is continuously stirred to transfer for drying.

The coil-formed sending apparatus 3 above-mentioned has functions to scoop the drying object from one side of the bottom surface of the main body 1 along the side surface arranged in rotating direction and to scatter the drying object toward the central part. In this sense, the action of said coil-formed sending apparatus 3 is to scoop the drying object existing on the bottom part of the main body 1 to scatter and deposit it on the top layer of the drying object moving inside of said main body 1, and essentially differs from that of the screw of a screw mixer shown in FIG. 12(*a*). By these actions, the drying object can be transversely and totally stirred.

Figure 3:
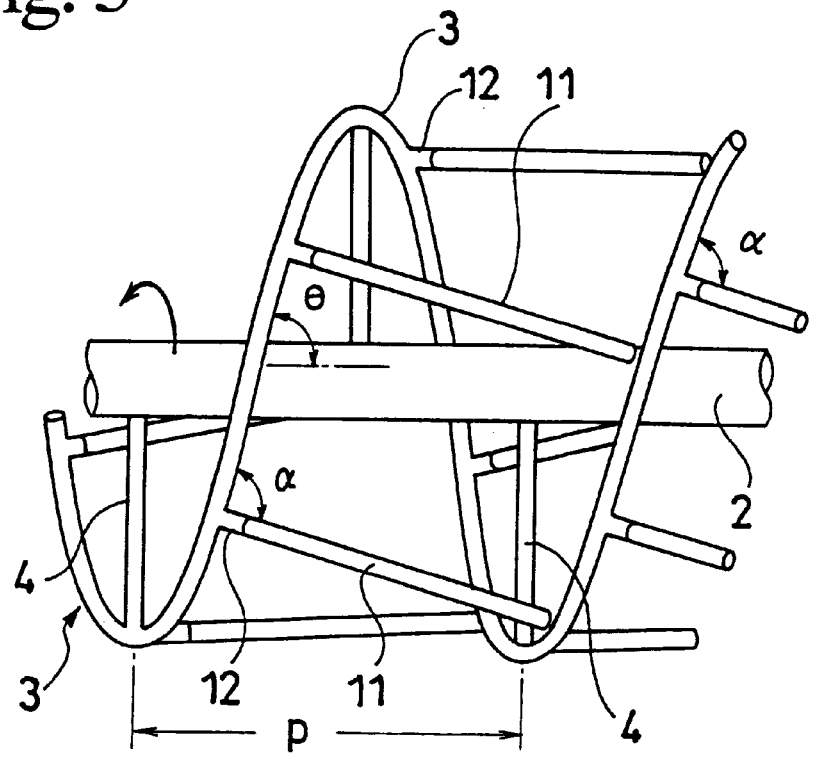
FIG. 3 is a partially enlarged side view of a coil-formed sending apparatus shown in the FIG. 1.

FIG. 3 is an enlarged partial diagram of the coil-formed sending apparatus 3 in the embodiment of the FIG. 1. The sending apparatus 3 mounted with a supporting bar 4 to surround the rotation shaft 2 has a plurality of bar-formed stirring members 11 fixed by a fixing parts 12. The stirring members 11 are arranged in 1 pitch p with a given distance along the periphery of the coil. In the example of the present figure, only one end of the stirring members 11 is fixed to the coil and the other end is a free end; both the ends may be fixed to the coil-formed sending apparatus 3.

Figure 4:
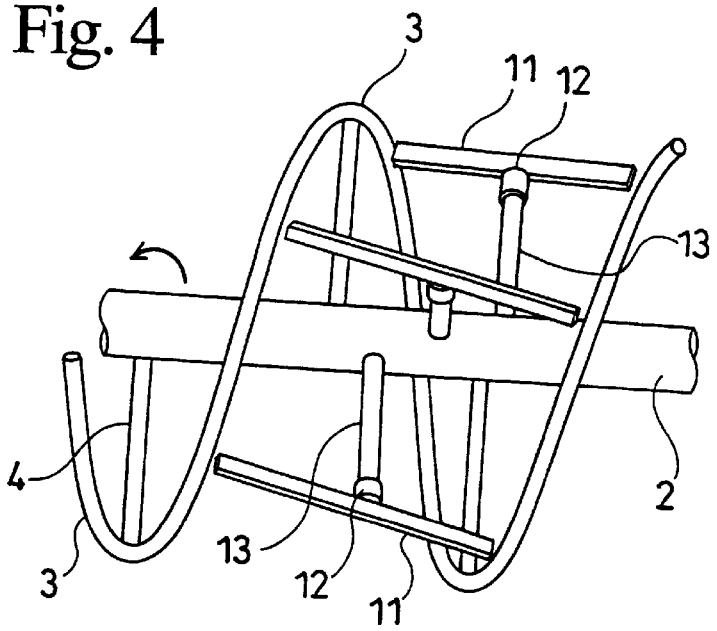
FIG. 4 is a partially enlarged side view of a coil-formed sending apparatus having a stirring member in another embodiment of the present invention.

FIG. 4 is an enlarged partial diagram of the coil-formed sending apparatus 3 in another embodiment of the present invention. In this embodiment, a plurality of the blade-formed stirring members 11 is radially fixed to the rotation shaft 2 by the fixing parts 12 and a supporting bar 13 and arranged in 1 pitch p along with the outer circumference of the coil.

In any one of the sending apparatus 3 of the FIG. 3 and FIG. 4, the number of the stirring member 11 arranged in 1 pitch p is not specifically restricted; however, normally 4~12. In addition, the tilting angle $\alpha$ of the stirring members 11 to the coil-formed sending apparatus 3 is made as larger than a tilting angle $\theta$ (the angle of a screw) to the direction of rotation shaft of the coil. Thus, the stirring member 11 functions to return reversely stirring the drying object by rotation together with the sending apparatus 3.

Figure 5:
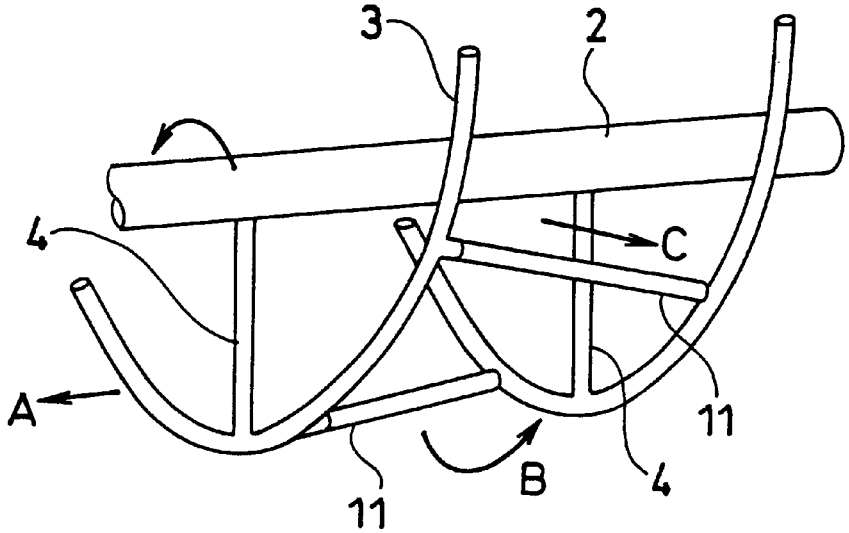
FIG. 5 is an explanatory illustration of movement of a drying object inside the drying system main body.

FIG. 5 is an explanatory illustration of movement of a drying object in the main body 1; granular or flake-formed drying object is advanced as the arrow A by pressure to the bottom surface of inside wall and the side wall of the main body 1 with the coil-formed sending apparatus 3.

Further, the stirring member 11 along with the bottom surface of inside wall of the main body together with the sending apparatus 3 functions to scoop down the drying object from top to bottom of one side and scoop up the drying object from bottom to top of the other side as the arrow B.

The drying object flows down along the inclination of the stirring member 11 as the arrow C, when the drying object has been raised to a height of the side surface of the inside wall of the main body. This carries out "retreating or reversely sending movement". Thus, the drying object repeats a series of periodical movement of "advancing, scooping and scattering, and partial retreating" in each pitch p of the coil; by these movements, the drying object can contact enough with a gas passing through the main body 1 and received enough far-infrared radiation radiated from the top of the main body 1.

The first feature of the invention is the use of a coil-formed sending apparatus 3, transverse stirring action to scoop and scatter while advancing the drying object by action of the screw or spiral of the sending apparatus 3 on the basis of arrangement of the stirring member 11 in 1 pitch p of the coil, and constitution to retreat a part of the drying object.

FIG. 6 is an explanatory illustration showing a method for mounting a stirring member 11 to the coil-formed sending apparatus 3 in the sending apparatus 3 shown in the FIG. 3. The fixing part 12 comprises a sleeve 14 connected to the coil and a plurality of fixing screws 15, and has been fixed to allow detaching and attaching freely by the fixing screw 15 after engaging a solid bar stirring member 11 with the sleeve 14. Besides, as shown in the bottom side of the FIG. 6, the tilting angle $\alpha$ of the stirring members 11 to the coil-formed sending apparatus 3 can be freely changed by replacing the stirring members 11 bent around the side end of mounting part to this one. According to this, the degree of movement to retreat the drying object can be varied.

FIG. 7 is an explanatory illustration showing another method for mounting a stirring member to a rotation shaft 2 in the sending apparatus 3 shown in the FIG. 4.

The fixing part 12 comprises the sleeve 14 connected to the stirring members 11 and a plurality of fixing screws 15, wherein the tilting angle $\alpha$ can be freely changed by fixing the supporting bar 13, that has been fixed to the rotation shaft 2 and engaged with the sleeve 14, with a fixing screw 15. The method for fixing the stirring members 11 as shown in the FIG. 6 and FIG. 7 is to be considered in all respects as illustrative and not restrictive to this mounting method.

By the constitution above-mentioned, the tilting angle $\alpha$ of the stirring members 11 to the coil-formed sending apparatus 3 can be freely changed. Increasing the tilting angle $\alpha$ increases the retreating rate of the drying object and increases the amount of a part of the drying object returned advancing. Thus, the transfer speed of the drying object can be freely regulated.

The second feature of the invention is the freely adjustable advancing distance of the drying object by a flow of retreating, returning, or reversing the drying object on the basis of the change of the angle $\alpha$ of said stirring members 11 to the sending apparatus 3.

Further, the steady operation of the continuous drying system requires almost constant rate of supplying (i.e., discharging rate) the drying object. However, decreased transfer speed increases a staying quantity resulting in the prolongation of staying time, i.e., drying time.

Although not illustrated, when a driving machine installed in a hollow rotation shaft can change the tilting angle $\alpha$ of the stirring member 11 to the sending apparatus 3 from outside of the drying system main body, optimal and effective drying can be carried out by controlling to match property and size of the drying object and proceeding situation of drying.

The transfer speed of the drying object depends on the rotation speed of the rotation shaft 2, the supplied or stayed quantity of the drying object. However, a drying time can be precisely regulated by appropriate selection of both the tilting angle $\alpha$ and the rotation speed.

The present invention is characterized by having a function to transfer the drying object to a certain direction or scoop up a part of the drying object to scatter in the central part by rotation of the coil-formed sending apparatus 3 along with the inside surface of the drying system main body, and also a function to retreat or return a part of the drying object by sliding down along with the stirring member 11, scooping up the drying object by the stirring member 11 that rotates together with the sending apparatus 3.

Thus, the action of the stirring member 11 regulates transferring quantity or transfer speed of the drying object in the continuous drying system to result in possible regulation of a drying time without direct effect of the rotation of the coil-formed sending apparatus 3.

Figure 11:
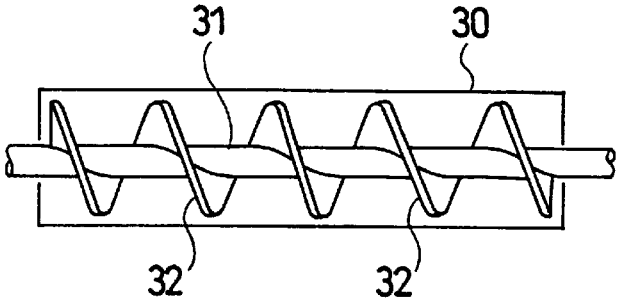
FIGS. 11(*a*) and FIG. 11(*b*) are sectional diagrammatic views showing a representative conventional drum mixer.
Figure 11:
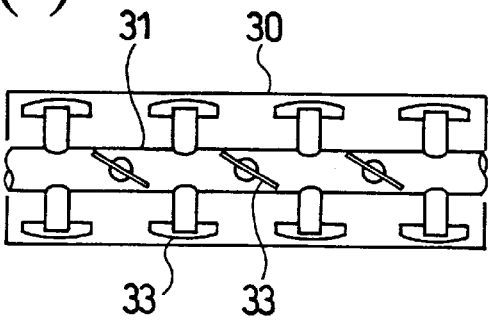

The sending apparatus 3 of the present invention is not a screwformed formed one as shown in the FIG. 11 (*a*), but a coil-formed one rotating in the inside surface of the main body 1, and has a clearance between this and the rotation shaft 2. The sectional shapes of these sending apparatus 3 or the stirring member 11 can be solid cylindrical bar, rectangular one represented by ribbon- or blade-shape, etc. The size and the tilting angle allow regulating stirring action and retreat action.

Consequently, the kind of a drying object and the size of the continuous drying system allow to realize the optimal drying conditions by changing the pitch of the coil of the sending apparatus 3 and changing the kind, the size, or the tilting angle of the stirring member 11.

The pitch p of the coil is—by the reason above-mentioned—changed according to the size of the continuous drying system or the kind of the drying object; normally, it is preferable to be 0.3~2 times the outer diameter 2r of the coil. On the other hand, the distance R−r between the outer circumference of the coil and the surface of the inside wall of the main body 1 is determined in consideration of the granular size and shape of the drying object; normally, it is 0.5~5 mm.

The continuous drying system according to the present invention developed particularly for drying of foods has the following characteristics.

A. The drying object can enough contact with air supplied to the main body 1 on the basis of strong, transverse, whole stirring of the drying object while transferring through the main body 1 and according to a condition, stirring to scatter in the main body 1. Drying rate can be satisfactorily increased even at a low temperature for drying. Besides, even drying can be realized by even exposure of far-infrared radiation radiated to the drying objects in the main body 1.

B. No uneven drying occurs, because the drying object is transversely stirred, as if tea leaves are scattered.

C. Controlling the tilting angle $\alpha$ of the stirring member 11 and the rotation speed of the rotation shaft 2 allows to control appropriately sending rate—i.e., drying time—of the drying object.

D. The drying objects can be vigorously stirred flowing smoothly, if the drying object is granular and flake-formed solid.

Therefore, the continuous drying system of the present invention is suitable for drying a flake-formed food such as a sliced vegetable, fruit, and fish meat as well as a granular food such as beans, grains, etc.

The heating means for heating the drying object are exemplified as follows.

1. A method for heating the drying objects by arranging an electric heater or a far-infrared heater on the top of a main body 1.

2. A method to constitute the inside wall surface of the main body 1 with a material having good heat conductivity and to install an electric heater or a steam heater on the back of the material.

3. A method to supply steam of a high temperature to the jacket that has been mounted to the main body 1.

4. A method to contact a heating object with a heating gas such as heated air supplied to the inside of the main body 1.

As described before, various means can be employed as a means for heating the drying object. These means can be-singly or in combination—employed according to the kind and treated quantity of the drying object.

In order to yield a dried food having the better flavor in drying a food, it is preferable to employ a heating means by selection, in addition to the stirring means for said drying object. One of the preferable means is radiation heating by a far-infrared heater.

Figure 8:
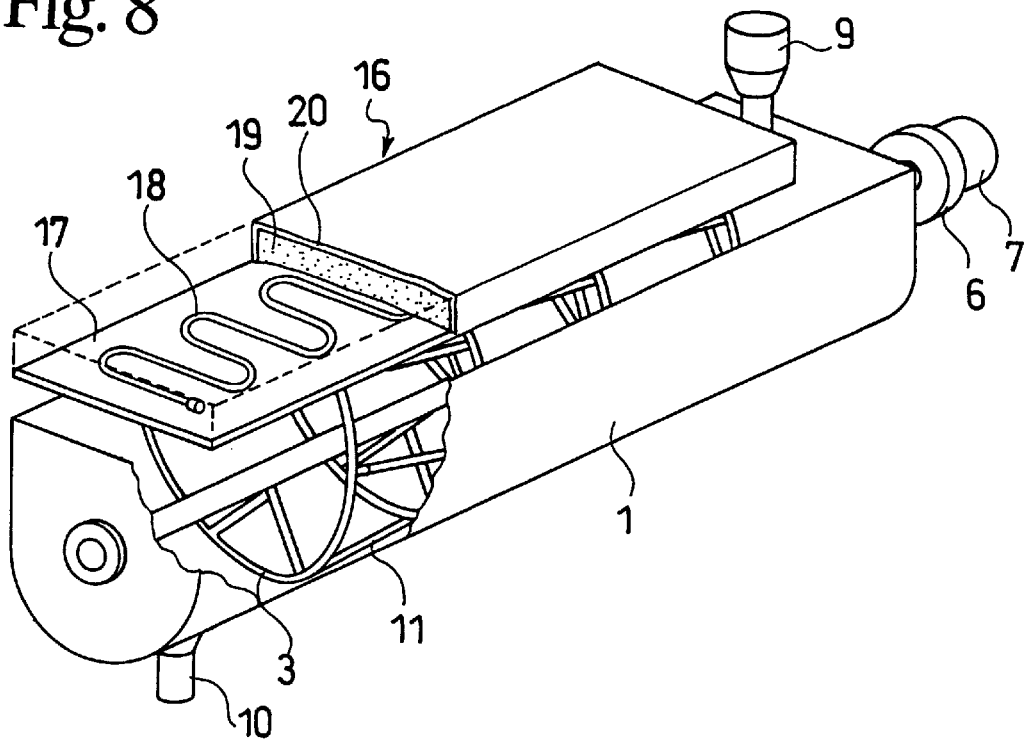
FIG. 8 is a partially fragmented perspective side view showing a part of the continuous drying system for food, of the second embodiment of the present invention.

FIG. 8 is the explanatory illustration of the continuous drying system for food, of another embodiment of the present invention. Granular or flake-formed drying object supplied into the main body 1 is stirred by the coil-formed sending apparatus 3 with the stirring member 11, and a part of the drying object is transferred by controlling retention time to return.

During the step, a far-infrared heater arranged to cover almost the whole surface of the ceiling surface effectively heats the food. The far-infrared heater 16 comprises a far-infrared radiating body 17 radiating a large quantity of far-infrared radiation from its bottom, a sheath heater 18 arranged on the back surface of radiating body 17, and a thermal insulation member 19 and a cover 20 outside of the radiating body 17.

The far-infrared radiating body 17 has a metal plate having ceramic coating layer on the bottom surface, and its back surface is heated by the sheath heater 18 to radiate far-infrared radiation of a wavelength suitable for heating of food.

Ceramics used are substances showing a high radiation rate of far infrared radiation and exemplified by single component of alumina, titania, and zirconia, mixture of them, or complex oxide of them. A powder form of these substances is used for coating of the surface of a metal plate by plasma thermal spraying, etc.

In addition, the sheath heater 18 is connected to a power source having a power regulator to regulate a heating power to make the temperature of a heating food suitable, for example, 40~50° C. or lower. In the drying system, the whole surface of a food is evenly and mildly heated to prevent uneven drying as a characteristic. Particularly, a granular or flake-formed food has relatively large surface area and contacts well with a surrounding gas to increase drying rate at a low drying temperature as described before.

As already described, it is preferable for yielding a flavorful dried food by drying vegetables, fruits, etc. that a drying temperature is maintained to a temperature near a room temperature such as 35~40° C. or lower as possible.

In order to increase the drying temperature at such low temperature, it is preferable that fresh air is supplied into the main body 1 and the interior of the main body 1 is maintained to a condition of a reduced pressure to reduce a vapor pressure. As means for reducing the pressure, the following method is good: fresh air or heated air is supplied from one side of the main body 1 and simultaneously, exhausted from the other side to establish a reduced pressure condition based on the difference between supplying power and exhausting power. The degree of pressure reduced is preferably 0.3 kPa (3 mbar) to 1 kPa (10 mbar) for foods; for grains, etc., the degree of reducing pressure may be increased.

On the other hand, drying rate can be increased to increase further the drying efficiency by cooling and dehumidifying the supplied air to the main body 1 or air containing a large volume of moisture refluxed from the main body 1, heat again to make dried air to supply to the main body 1.

Figure 9:
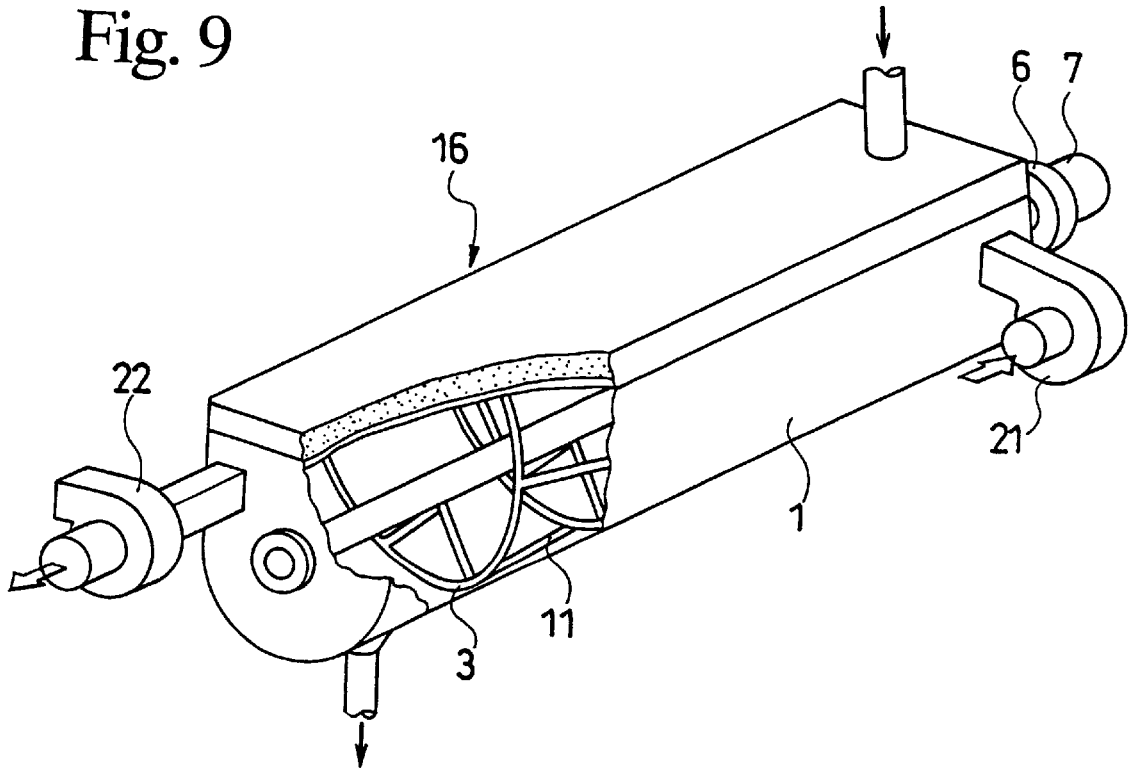
FIG. 9 is a partially fragmented perspective side view showing a part of the continuous drying system for food, of the third embodiment of the present invention.

FIG. 9 is an explanatory illustration of the continuous drying system for food, of the third embodiment of the present invention. In the embodiment, the main body 1 is air-tightly made, of which one end and the other end are connected to an air supplying fan 21 and an exhausting fan 22, respectively through a duct. The exhausting fan 22 exhausts air largely moisturized in the main body 1 and functions to make an air flow in a certain direction in the main body 1.

Both the air-supplying fan 21 and the exhausting fan 22 can regulate airflow by a means, not illustrated, for air regulation. As described before, the exhausting powers stronger than a supplying power can ordinarily keep the inside of the main body to the condition of a reduced pressure suitable for drying a drying object.

The inventors found that the maintenance of a pressure of environmental air to the condition of 1 kPa(10 mbar) or more higher than an atmospheric pressure yields a drying rate equal to that of drying at a temperature ranging 40~50° C. and an atmospheric pressure even for a food of which temperature is 30~40° C. This means that keeping a reduced pressure of environmental air allows lowering a drying temperature.

As known from such descriptions, heating at a lower temperature in comparison with common drying method with hot air allows preventing the deterioration of food quality by enzyme action and the propagation of bacteria and yielding dried foods having flavor identical with original fresh foods.

The continuous drying system according to the present invention is suitable for drying sliced pieces of such vegetables as sweet potatoes, potatoes, carrots, Japanese radishes, pumpkins, Welsh onions, burdocks, etc., flake-formed pieces of chopped vegetables such as cabbages, bean sprouts, onions, etc., chopped pieces of fruits such as apples, pineapples, etc., sliced pieces of fishes and shell fishes such as salmons, mackerels, octopuses, squids, abalone's, scallops, etc.

As well, the continuous drying system of the present invention is suitable for drying a granular food such as beans, grains, etc. and granular foods by dicing of relatives of potatoes, yams, and root crops. The remaining water content of these granular or flake-formed foods can be appropriately regulated by controlling the drying time and by drying at a relatively low temperature. By this, a dried food can be prepared to keep the flavor of the original food and possible long term preservation.

Figure 10:
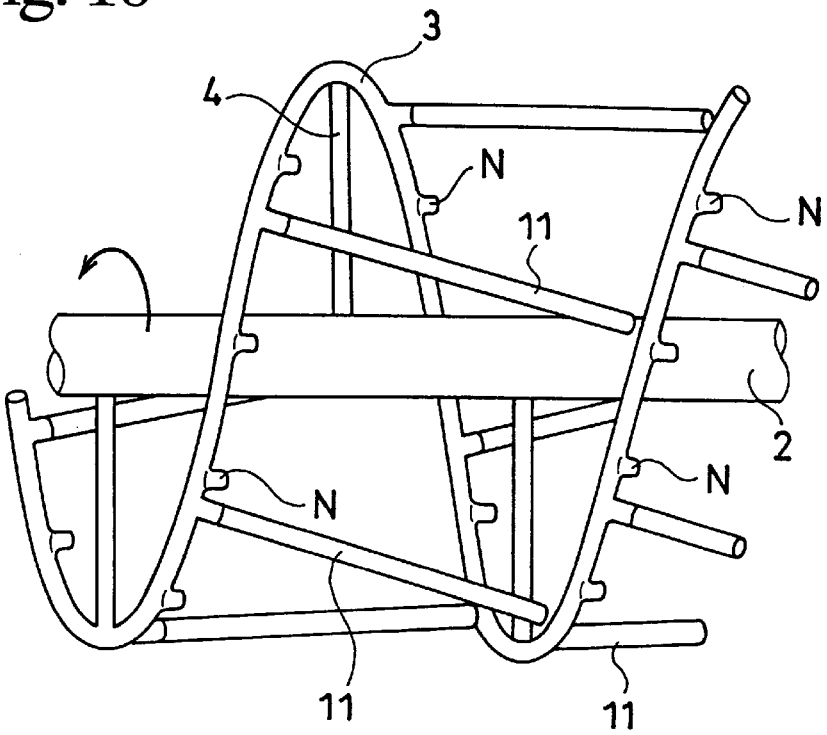
FIG. 10 is an illustration showing a system to spray a gas from a gas spraying nozzle that is mounted to a coil-formed sending apparatus made from pipes.

FIG. 10 shows a modified retreating or returning means for the drying object, and also shows a stirring machine having a nozzle for spraying a gas toward the back in a given distance along the coil-formed sending apparatus 3 made by piping in addition to a hollowed rotation shaft 2 used for the passage of a gas. In this example, no nozzle N has been mounted to the stirring member 11 connected to the sending apparatus 3; however, it is possible to be fitted to the same.

The rotation of the sending apparatus 3 having said structure together with the rotation shaft 2 moves the nozzle N so as to advance from the supply side to the discharge side making the excursion of a spiral shape in the main body 1. A part of the drying object can be retreated or returned by spraying heated air or a proper gas to the reverse direction of the advancing direction of the drying object from the nozzle. The retreating or returning distance allows regulating the retention time of the drying object in the main body 1.

In the example, the nozzle N has been mounted to the sending apparatus 3 itself; however, it can be separately installed. In addition, arranging the nozzle N or a spraying hole in the inside surface of the main body 1 allows accurate regulation of the retention time of the drying object.

Figure 12:
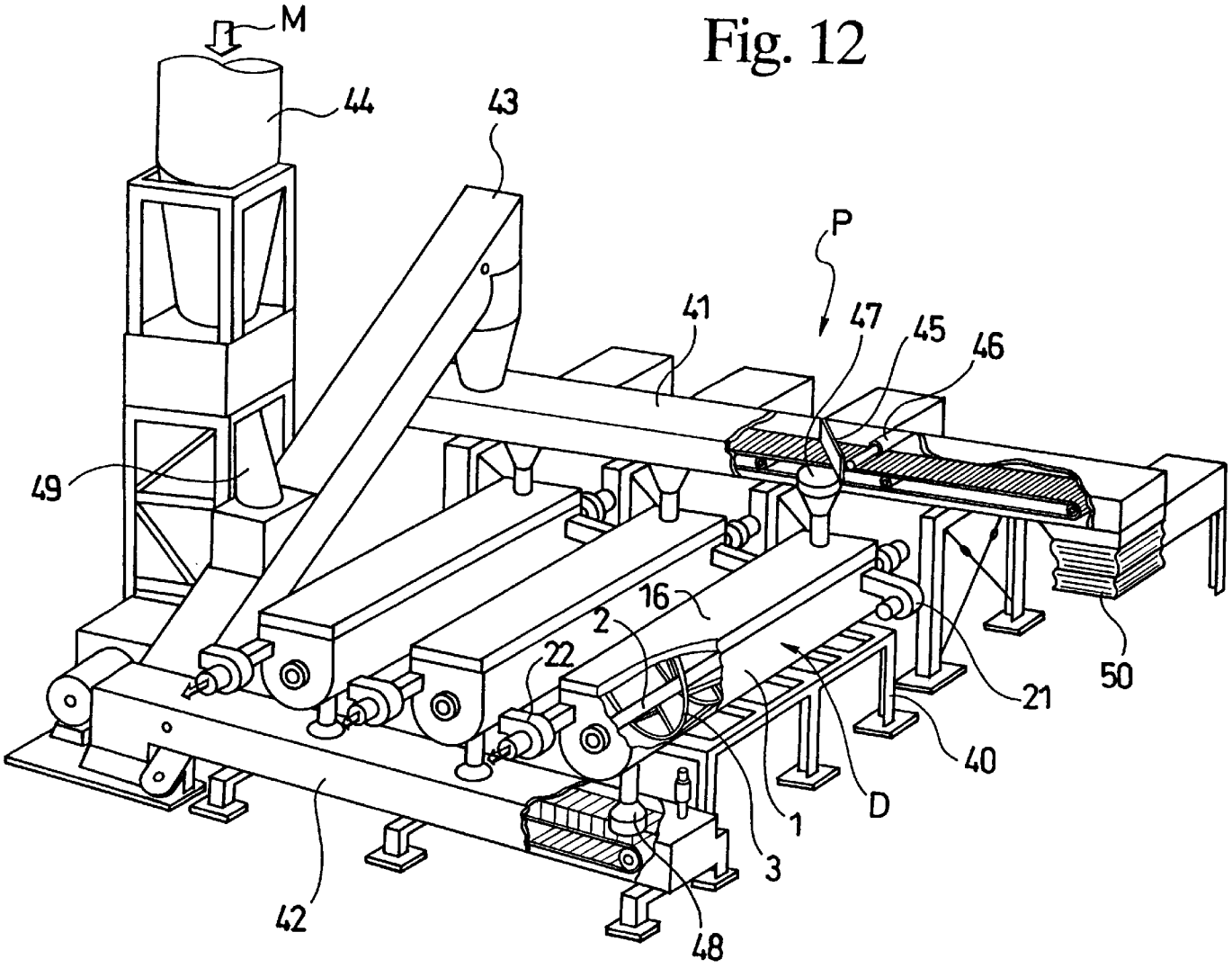
FIG. 12 is a perspective side view showing an example of a continuous drying system for food by using the continuous drying system shown in the FIG. 8 or FIG. 9.

FIG. 12 is a perspective side view of a continuous drying system P installed in a factory, with which the continuous drying system D—shown in the FIG. 9—has been assembled, to process for drying a mass of granular foods, particularly unhulled rice M.

In the continuous drying system P, a plurality of the continuous drying systems D has been installed in parallel to each other on a stand 40, a supplying conveyer 41 and circulating conveyer 42 have been installed in upstream side and downstream side, respectively, and both the conveyers 41 and 42 have been connected to each other by a connecting conveyer 43. These continuous drying systems D have substantially, the same function as that shown in the FIG. 9.

In the middle position of the supplying conveyer 4 above-mentioned, a flow regulating board 45 for regulating the volume of supplying object has been installed in the position corresponding to a supplying hopper 47 installed in respective continuous drying systems D to regulate the supply of the drying object to the continuous drying systems D regulating its tilting angle by a cylinder 46. Although a detail in the drawing has not been illustrated, a short board has been used as the regulating board 45 in the first stage, a long one is in the second stage, and a full-width one is for the conveyer 41 as illustrated. Unhulled rice M loaded on the conveyer 41 is divided into three parts to supply to three sets of the continuous drying systems D.

The continuous drying systems D above-mentioned have a fan 21 for supplying air and a fan 22 for exhausting air as described with reference to the FIG. 9. The inside of the main body 1 is maintained to a given reduced pressure by controlling these fans.

A large energy of far-infrared radiation is radiated on unhulled rice M that is transferred through the main body 1 by the far-infrared heater 16 installed on the ceiling surface of the main body 1 to conduct heat directly to interior air.

The main body 1 has therein the coil-formed (spiral) sending apparatus 3 and the stirring member 11 that are driven in a given rotation speed. By the action of these units, unhulled rice M is stirred and partly returned by the stirring member 11 to regulate totally the transfer speed, dried by drying action in the main body 1 for a given time, and transferred from said discharging hopper 48 to the circulating conveyer 42.

No description has been made about the path of air circulating in the main body 1 of the continuous drying systems D. The main body 1 has an outer circulation fan to circulate air from the inside to the outside of the main body 1, in addition to these fans 21 and 22. Air heated by the far-infrared heater 16 in the main body 1 is supplied to the outer circulation fan and regulated to a given temperature suitable for drying by cooling with an air cooler in outer piping system, and subjected to dewatering processing, thereafter supplied again to the inside of the main body 1 to contact with the drying object.

In contrast with aforementioned description, when the quantity of heat generated by the far-infrared heater 16 is not satisfactory for heating the drying object in the main body 1, a heat quantity is added by hot water system, a vapor jacket, or an electric heater installed around the main body 1.

For example, when the quantity of heat generated by the far-infrared heater 16 is larger than the heat quantity lost by water evaporation from the drying object, the temperature of the interior of the main body 1 shows a tendency to become very high in comparison with that of the given temperature. In this case, maintaining the drying temperature for unhulled rice M of the drying object to 25~35° C. is realized by around 45° C. of the temperature of the far-infrared heater 16. However, there is a tendency that the temperature of air flowing through the inside of the main body 1 becomes very high superior to the temperature of unhulled rice M.

Such high temperature denatures unhulled rice M and is to be avoid for the operation of systems and machines related to the present invention. Thus, the invention is constituted to have air cooler in the circuit of the outer circulation fan to drop the air temperature to a given temperature for supplying to the main body 1 through dewatering processing.

Unhulled rice M—the drying object conveyed from a rice field or preservative equipment—is supplied to a hopper 44, supplied to the connecting conveyer 43 through the supplying pipe 49 via a flow regulating valve not illustrated, supplied to an end of the supplying conveyer 41, and divided according to progress of the supplying conveyer 41 in order to supply to three continuous drying systems D respectively.

In these three continuous drying systems D, unhulled rice M under condition of said reduced pressure is heated by radiation of a large energy of far-infrared radiation, stirred by the coil-formed sending apparatus 3, and dried by subjecting to the stirring and returning actions by the stirring member 11 and regulating transfer speed in the main body 1.

In the continuous drying system P, a large amount of unhulled rice M is dried for a given time, discharged from a hopper 50 of the end part of the supplying conveyer 41, and packed for transportation or load a truck in bulk.

In a conventional method for drying unhulled rice M, unhulled rice M is dried by heating during passing it through the route of the heated gas that is a gas with a high temperature, generated by burning kerosene, and diluted with air to lower to about 60° C. The drying time is about 30 hours. A large proportion of unhulled rice M was denatured. In the present invention in contrast to the conventional method, a predetermined drying was completed after a short time as about 1 hour at a temperature of about 35° C. or lower to yield unhulled rice M never denatured.

What is claimed is:

1. A continuous drying system for a flake-formed or granular solid comprising;

a drying system main body, which has a semi-cylindrical inside bottom and is practically horizontally installed, having a means for supplying a drying object to one end thereof and a means for discharging the same to the other end thereof, a means for heating the drying object in said drying system main body or/and a means for supplying the drying gas in said drying system main body, a rotation shaft arranged on the axis of the semi-cylindrical bottom of said drying system main body and driven to rotate by a driving machine with a variable rotation speed, a coil-formed sending apparatus, composed of a cylindrical coil of which outer diameter is somewhat smaller than the diameter of the shaft of the semi-cylindrical bottom of said drying system main body, for transferring the drying object by the rotation of the rotation shaft to which said sending apparatus is mounted through a supporting bar, and many bars or blade-formed stirring members arranged in a position bridging between coil pitches along the outer circumference of said sending apparatus and mounted to the coil or said rotation shaft, wherein a retreat movement is given to the drying object by said stirring member mounted to the coil or said rotation shaft so as to make a tilting angle of said stirring member to the coil larger than the tilting angle to the axis direction of the coil.

2. A continuous drying system according to claim 1, wherein the transfer speed of the drying object can be changed by changing the tilting angle on the basis of mounting said stirring member to the coil or the rotation shaft and by using a fixing means allowing the tilting angle of said stirring member to be changeable.

3. A continuous drying system according to claim 1, wherein said continuous drying system for drying a flake-formed or granular food comprises a far-infrared radiating body to cover almost whole surface of a ceiling of said drying system main body and a heating source at the back of the far-infrared radiating body so as to heat a drying food with radiation heat from the far-infrared radiating body.

4. A continuous drying system according to claim 1, wherein said continuous drying system for drying a flake-formed or granular food comprises a supplying means for supplying air for the drying system in said drying system main body sealed and a discharge means for discharging air in said drying system main body, and is constituted to maintain a pressure in said drying system main body to an atmospheric pressure or under by regulating a supplying volume and a discharging volume.

5. A continuous drying system according to claim 2, wherein said continuous drying system for drying a flake-formed or granular food comprises a far-infrared radiating body to cover almost whole surface of a ceiling of said drying system main body and a heating source at the back of the far-infrared radiating body so as to heat a drying food with radiation heat from the far-infrared radiating body.

6. A continuous drying system according to claim 2, wherein said continuous drying system for drying a flake-formed or granular food comprises a supplying means for supplying air for the drying system in said drying system main body sealed and a discharge means for discharging air in said drying system main body, and is constituted to maintain a pressure in said drying system main body to an atmospheric pressure or under by regulating a supplying volume and a discharging volume.

7. A continuous drying system according to claim 3, wherein said continuous drying system for drying a flake-formed or granular food comprises a supplying means for supplying air for the drying system in said drying system main body sealed and a discharge means for discharging air in said drying system main body, and is constituted to maintain a pressure in said drying system main body to an atmospheric pressure or under by regulating a supplying volume and a discharging volume.

* * * * *

UNITED STATES PATENT AND TRADEMARK OFFICE

CERTIFICATE OF CORRECTION

PATENT NO. :6,079,118

DATED :June 27, 2000

INVENTOR(S) :Shin KIYOKAWA

It is certified that error appears in the above-identified patent and that said Letters Patent is hereby corrected as shown below:

Column 2 Lines 9-10 "its activate" should read --it activates--.

Column 2 Line 55 "comprises;" should read --comprises:--.

Column 3 Line 21 after "gas" delete --,--.

Column 3 Line 48 "fragmented showing" should read --fragmented,--.

Column 3 Line 49 after "view" insert --showing--.

Column 4 Line 10 "FIGS." should read --FIG.--.

Column 6 Line 67 "screwformed formed" should read --screw-formed--.

Column 8 Line 4 delete the first occurrence of "the" and insert --an--.

Column 10 Line 8 after "substantially delete --,--.

Column 10 Line 67 "avoid" should read --avoided--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*